US005964000A

United States Patent [19]

Lindley, Sr.

[11] Patent Number: 5,964,000

[45] Date of Patent: Oct. 12, 1999

[54] METHOD FOR MANUFACTURING PANTYHOSE

[76] Inventor: James Thomas Lindley, Sr., 2510 Pineway Dr., Burlington, N.C. 27215

[21] Appl. No.: 08/977,226

[22] Filed: Nov. 24, 1997

[51] Int. Cl.[6] ..... D06B 1/02

[52] U.S. Cl. ..... 8/150; 28/154

[58] Field of Search ..... 8/150; 53/431; 28/153, 154

[56] References Cited

U.S. PATENT DOCUMENTS

| | | |
|---|---|---|
| 3,120,049 | 2/1964 | Spurgeon . |
| 3,181,749 | 5/1965 | Helliwell . |
| 3,431,656 | 3/1969 | Luckenbach . |
| 3,686,726 | 8/1972 | Glaze, Jr. et al. . |
| 3,704,565 | 12/1972 | Glaze, Jr. . |
| 3,955,227 | 5/1976 | Siegfried . |
| 4,214,331 | 7/1980 | Freeze . |
| 4,865,463 | 9/1989 | Howard . |
| 5,651,483 | 7/1997 | Bell et al. . |

*Primary Examiner*—Frankie L. Stinson
*Attorney, Agent, or Firm*—Rhodes & Mason, P.L.L.C.

[57] ABSTRACT

A method for manufacturing pantyhose efficiently year round. The method includes dyeing and post-boarding the pantyhose during one portion of the year in the normal manner. During slack order times, the pantyhose are pre-boarded, folded and bagged for subsequent dyeing. A portion of the bagged pantyhose are then stored until orders are received and the correct dyes are known. In the preferred embodiment, a dye bag is used having a base portion sized approximately equal to the size of a pair of folded pantyhose. Between about 6 to 12 pair of the pantyhose are folded together before stacking into the dye bag. Between about 1 to 3 dozen of the folded together pantyhose are then dyed in a single dye bag. The pantyhose are then removed from the dye bag, dried, individually folded, and packaged for shipment to the end user.

34 Claims, 2 Drawing Sheets

METHOD FOR MANUFACTURING PANTYHOSE

BACKGROUND OF THE INVENTION

1. Field of the Invention

The present invention relates generally to hosiery and, more particularly, to a method for manufacturing pantyhose efficiently year round.

2. Description of the Prior Art

Historically, the demand for pantyhose varies greatly throughout the year as the weather and seasonal clothing variances of the public changes. To the manufacturers of pantyhose, this makes it very difficult for scheduling consistent manufacturing patterns as for part of the season demand greatly outstrips supply while during the non-peak seasons supply is much greater then the immediate demand. As a result, manufacturing facilities are running either at 100% of efficiency or at a much-reduced rate. Workforce requirements greatly fluctuate for meeting this demand which makes it difficult for a manufacturer to maintain a constant size workforce without mass hirings and firings every year.

Another problem with the cyclical demand rates is that demand cannot be met during the peak seasons. Each manufacturing facility is only able to produce a given amount of garments which is often less than the demand. The production quantities that each facility is able to produce is usually dictated by the boarding process which causes a bottleneck in the production process.

Finally, any new system of manufacturing hosiery must be compatible with existing equipment in order to keep capital costs reasonable.

Thus, there remains a need for a new and improved method for manufacturing pantyhose which is efficient year round while, at the same time, can be used without extensively modifying existing hosiery facilities.

SUMMARY OF THE INVENTION

The present invention is directed to a method for manufacturing pantyhose efficiently year round. The method includes dyeing and post-boarding the pantyhose during one portion of the year in the normal manner. During slack order times, the pantyhose are pre-boarded, folded and bagged for subsequent dyeing. A portion of the bagged pantyhose are then stored until orders are received and the correct shades are known.

In the preferred embodiment, a dye bag is used having a base portion sized approximately equal to the size of a pair of folded pantyhose. Between about 6 to 12 pair of the pantyhose are folded together before stacking into the dye bag. Between about 1 to 3 dozen of the folded together pantyhose are then dyed in a single dye bag. The pantyhose are then removed from the dye bag, dried, individually folded, and packaged for shipment to the end user.

Accordingly, one aspect of the present invention is to provide a method for manufacturing pantyhose efficiently year round. The method includes: (a) dyeing and post-boarding the pantyhose during one portion of the year; and (b) pre-boarding, folding and bagging for dyeing the pantyhose during the remaining portion of the year.

Another aspect of the present invention is to provide a method for manufacturing pantyhose efficiently year round. The method includes: (a) pre-boarding, folding and bagging for dyeing the pantyhose; and (b) storing a portion of the bagged pantyhose until orders are received.

Still another aspect of the present invention is to provide a method for manufacturing pantyhose efficiently year round. The method includes: (a) dyeing and post-boarding the pantyhose during one portion of the year; (b) pre-boarding, folding and bagging for dyeing the pantyhose; and (c) storing a portion of the bagged pantyhose until orders are received, wherein step (b) further includes using a dye bag having a base portion sized approximately equal to the size of a pair of folded pantyhose.

These and other aspects of the present invention will become apparent to those skilled in the art after a reading of the following description of the preferred embodiment when considered with the drawings.

DESCRIPTION OF THE PREFERRED EMBODIMENTS

Figure 1:
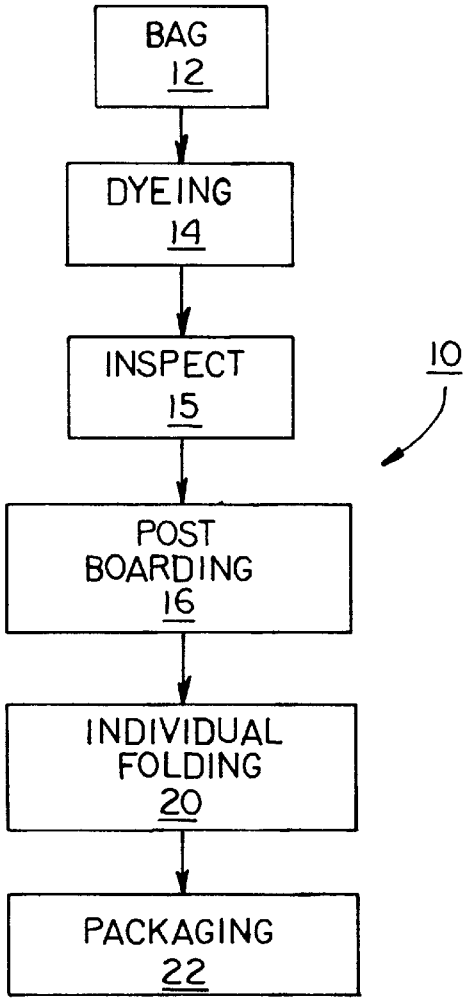
FIG. 1 is a flowchart depiction of the first dyeing process.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, there is illustrated the most common and widely practiced production sequence for the dyeing and packaging of pantyhose. After the pantyhose are knit, they are placed into a dye bag 12. The garments can be loosely placed into the bag without folding or requiring certain alignment provided they are not placed too densely which could hamper the penetration of the dyeing process. The dye bag is usually of a mesh construction to allow for the dye to completely surround and penetrate into the garment to provide for a consistent, high-quality dyeing 14. The bag is preferably sized to hold between about 5–10 dozen garments in a loose arrangement for adequate dye penetration. This large size reduces the amount of handling needed by an operator which helps to keep the cost per garment at a minimum. One skilled in the art will also realize that the garments need not be placed into a dye bag prior to dyeing.

After the garments are removed from the dye tub, they may be visually inspected for dyeing or knitting defects 15. Garments which do not meet quality standards may be weeded out and placed into a second-quality or rejected category at this time. This inspection process insures that the only first-quality goods will be boarded, folded and packaged as these labor-intensive steps add cost to the manufacturing process that is not necessary for lesser quality garments.

The inspected garments next proceed through a boarding process 16. The boarding process comprises placing the pantyhose onto a form and applying heat and steam. U.S. Pat. Nos. 3,790,047 and 4,925,022 describe the boarding process and is herein incorporated by reference in their entirety. This boarding process serves to dry the garments and remove unsightly wrinkles to give a more aesthetically appealing look. The boarding process must be above the glass transition set temperature of the yarn such that the garment maintains its aesthetic quality and does not wrinkle.

Finally, the garments are individually folded 20 keeping the garments in an unwrinkled and pleasing appearance. The garments are finally packaged 22 and ready for sale. Folding and packaging of the garments can be done on an individual garment basis or in combinations having more than one garment per package depending upon the needs of the user.

In the preferred embodiment, the process generally denoted as 10 in FIG. 1 is used during the peak demand periods when production is being outstripped by demand. The boarding process 16 is the slowest and most time-demanding step such that it dictates the amount of production that is capable. Specifically, the most one boarder can do per shift is 150 dozen. For a 20,000 dozen per week plant, this requires at least 7 persons boarding, 3 shifts a day and 7 days a week to meet demand. During peak periods, production may possibly be increased to 22,000 dozen but no more.

Figure 2:
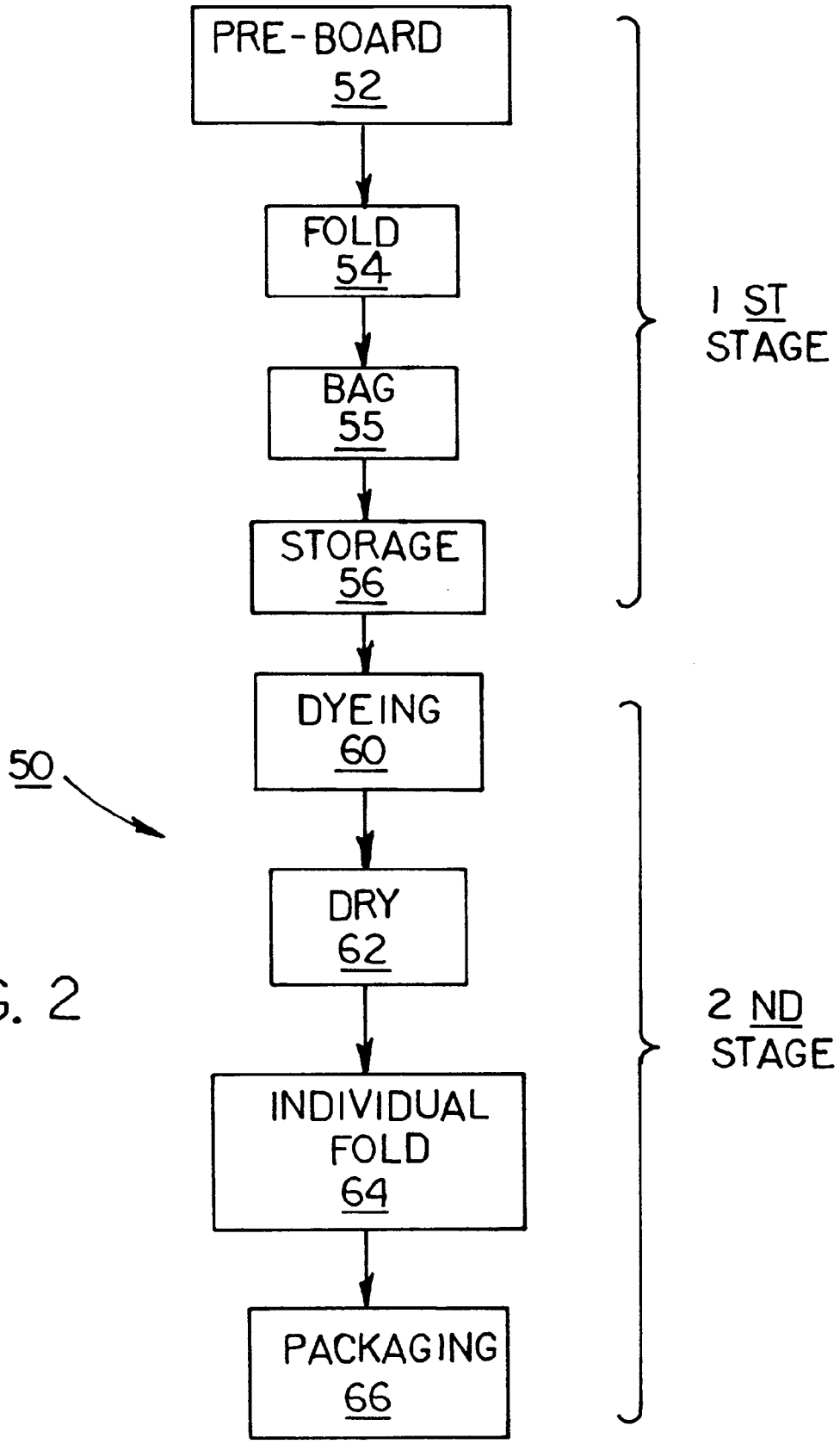
FIG. 2 is a flowchart depiction of the second dyeing process.

As demand wanes and production output is greater, the present invention incorporates a second production sequence shown generally in FIG. 2 as 50. This sequence allows for production rates to stay more consistent and steady throughout the entire year without experiencing the peaks and valleys that are normal for the business. After the garment has been knitted, it proceeds to a boarding process 52. The temperature of the garment must be raised above the glass transition temperature of the yarn which is about 240 degrees Fahrenheit. This is critical so the garment is set into proper proportions and shaped as this is the only boarding process in the operation. It is important that the temperature of the garment reach about 240 degrees F. as if the temperature is too low, the garment will not shrink into the desired shape to fit a wearer but will instead maintain its knitted tubular proportions. If the temperature is raised too high above 240 degrees F., the stitching of the yarn will begin to distort. As described above, the boarding process removes wrinkles from the garments and produces an aesthetically pleasing look.

Unlike the prior sequence, the garment has yet to be dyed therefore no drying is required. As the boarding process is the most time consuming step, it is done first in this sequence as demand is not as great as output and the boarding step is not causing a bottleneck. When demand increases again, these garments have already been boarded and can proceed through the remainder of the process without being bottlenecked in boarding.

Pre-boarding of the garments before dyeing has several advantages over boarding dyed garments. Dyed garments often have streaks or other defects caused by exposing them to steam and condensation in the boarding process. In pre-boarding operations, the garments have not been dyed and therefore cannot be damaged during the boarding step. Additionally, the dyed garments can leave dye on the boarding forms that must be cleaned prior to boarding a lighter shade garment. Cleaning the boarding forms between each batch of garments further slows the boarding process that is already the bottleneck of the entire pantyhose process.

Pre-boarding of the garments prior to dyeing is not common or expected in the art. This sequence results in second-quality garments due to knitting defects to be boarded. Traditionally, defective and second-quality garments may not be boarded as described in the first sequence 10.

The garments are next folded 54 in a manner to retain their aesthetics and also to place them in position for dyeing. The garment is opened and laid in an outstretched position and then the toe is folded to a position just short of the heavier denier yarn at the opposite end. Finally, the folded end opposite the elastic yarn end is again folded to give the garment a generally rectangular shape contained within a minimum volume. It is important that the heavier denier sections of the pantyhose not be folded together as this arrangement results in a more dense packaging that is difficult for the dye to penetrate during the dyeing process resulting in an inconsistent dyeing or requiring more time in the dye bath for the dye to completely penetrate the pantyhose.

More than one garment can be folded together, for example, three individual pantyhose can be folded into a single bundle which reduces material handling costs. The number of garments that can be folded together is dependent upon the dyeing process and amount of pressure and dyeing times for giving a complete, thorough dyeing of all garments within the bundle. Heavier denier items require longer dyeing times or increased pressure to insure complete saturation of the yarn and a high-quality consistent dyed pantyhose. The folded garments are then placed 55 into a dye bag shown as 60 in FIG. 3.

Figure 3:
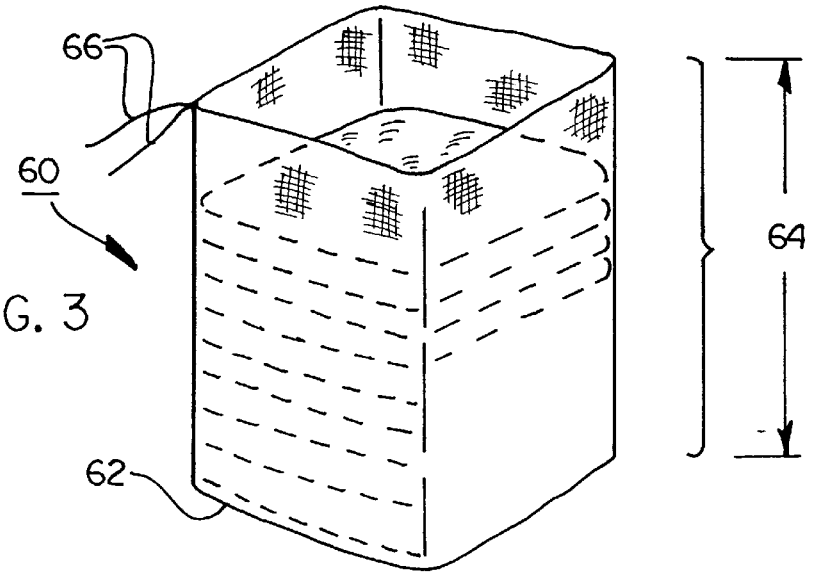
FIG. 3 is a perspective view of the dye bag.

The dye bag has a base 62 of ample size such that the folded garments can be placed on the base in a flat alignment without causing wrinkles to form. In one embodiment, this size is about 6"–8" square base and a height of about 8"–20. The top edge of the bag is equipped with a means for closing and tying the bag such that the folded garments cannot escape. In one embodiment as shown in FIG. 3, the means for closing the top edge of the bag is a tie string 66. The bag is constructed of a mesh material which allows for dye to penetrate through to the enclosed garments when it is placed in a dye tub. One example of a bag is a size 10 inches by 18 inches dye net manufactured by J.C. Custom Sewing, Inc., of Gibsonville, N.C. The bag is sized to hold between about 1–3 dozen garments in a stacked arrangement.

Unlike presently used dyeing methods that use bags capable of holding large dozens of garments, this process can only hold 1–3 dozen garments. The size of the bag can be reduced by choking down on the collar to insure the folded garments are secured in the bag and will not move about resulting in wrinkling the garments. A larger bag can cause garments to become wrinkled and of aesthetically poor quality due to movement of the individual folded garments within the large bags. The smaller sized bags further teach against common usage as additional material handling of the garments is required.

After the garments are bagged, they are placed into storage 56. The storing of the garments provides for output to be approximately constant throughout the year without requiring huge swings in production rates. The garments may be stored directly in the dye bags 60 until they are needed for dyeing. At that point, they are pulled from storage and dyed 60 in the same manner as described above. One skilled in the art will understand that the garments can be placed into the dye bags and directly dyed without being stored.

The dyeing process must be performed at a temperature below the glass transition temperature of the yarn that was instilled during the pre-boarding step. Provided the dye temperature is below the glass transition temperature, the garment will not lose its desired shape it obtained during the boarding process. The dyeing temperature for disperse dyes is between about 140–165 degrees Fahrenheit and for acid dyes between about 180–205 degrees F. This lower dyeing temperature ensures a second post-boarding step is not required which saves manufacturing time and costs.

After the garments are dyed, they are removed from the dye bag for drying 62. This is an additional step not required in sequence 10 as the garments will not be dried in the boarding process. The garments are removed from the dye bag and unfolded into an extended, outstretched position. The garments are placed into a drying mechanism, such as Cetme 5000 Reggio EM-Italy. The garments need not be individually unfolded and extended, but may be able to be unfolded in bundles and adequately dried. The extent of unfolding and unbundling required for adequate drying is dependent upon the amount of heat and drying time.

Finally, the garments are individually folded 64 keeping the garments in an unwrinkled and pleasing appearance. The garments are finally packaged 66 and ready for sale. Folding and packaging of the garments can be done on an individual garment basis or in combinations having more than one garment per package depending upon the needs of the user.

Certain modifications and improvements will occur to those skilled in the art upon a reading of the foregoing description. By way of example, a cotton dye net could be used in place of a polyester dye bag provided the pantyhose garment is not snagged by the bag during the processing. It should be understood that all such modifications and improvements have been deleted herein for the sake of conciseness and readability but are properly within the scope of the following claims.

I claim:

1. A method for manufacturing pantyhose efficiently year round, said method comprising the steps of:

(a) dyeing and post-boarding said pantyhose during one portion of said year; and (b) pre-boarding, folding and bagging for dyeing said pantyhose during the remaining portion of said year.

2. The method according to claim 1, wherein step (b) further includes using a dye bag having a base portion sized approximately equal to the size of a pair of folded pantyhose.

3. The method according to claim 2, wherein said base of said dye bag is between about 6 to 8 inches square.

4. The method according to claim 3, wherein said dye bag is between about 8 to 20 inches high.

5. The method according to claim 1, wherein said one portion of said year includes at least one of the first and fourth quarters of said year.

6. The method according to claim 5, wherein said one portion of said year includes both of the first and fourth quarters of said year.

7. The method according to claim 1, wherein step (a) includes dyeing said pantyhose in a dye bag.

8. The method according to claim 7, wherein step (a) includes dyeing between about 5 to 10 dozen of said pantyhose in a single dye bag.

9. The method according to claim 1, wherein step (a) further includes individually folding each of said pantyhose after dyeing.

10. The method according to claim 9, wherein step (a) further includes packaging said folded pantyhose for shipment to an end user.

11. A method for manufacturing pantyhose efficiently year round, said method comprising the steps of:

(a) pre-boarding, folding and bagging for dyeing said pantyhose; and (b) storing a portion of said bagged pantyhose until orders are received.

12. The method according to claim 11, wherein step (a) further includes folding a plurality of said pantyhose together before bagging.

13. The method according to claim 12, wherein step (a) includes folding between about 6 to 12 pair of said pantyhose together before stacking in a dye bag.

14. The method according to claim 11, further including step (c) dyeing said pantyhose in a dye bag.

15. The method according to claim 14, wherein step (c) includes dyeing between about 1 to 3 dozen of said pantyhose in a single dye bag.

16. The method according to claim 14, further including step (d) removing said pantyhose from said dye bag and drying said pantyhose.

17. The method according to claim 16, wherein step (d) further includes individually folding each of said pantyhose after drying.

18. The method according to claim 17, wherein step (d) further includes packaging said folded pantyhose for shipment to an end user.

19. A method for manufacturing pantyhose efficiently year round, said method comprising the steps of:

(a) dyeing and post-boarding said pantyhose during one portion of said year;

(b) pre-boarding, folding and bagging for dyeing said pantyhose; and (c) storing a portion of said bagged pantyhose until orders are received, wherein step (b) further includes using a dye bag having a base portion sized approximately equal to the size of a pair of folded pantyhose.

20. The method according to claim 19, wherein said base of said dye bag is between about 6 to 8 inches square.

21. The method according to claim 20, wherein said dye bag is between about 8 to 20 inches high.

22. The method according to claim 19, wherein said one portion of said year includes at least one of the first and fourth quarters of said year.

23. The method according to claim 22, wherein said one portion of said year includes both of the first and fourth quarters of said year.

24. The method according to claim 19, wherein step (a) includes dyeing said pantyhose in a dye bag.

25. The method according to claim 24, wherein step (a) includes dyeing between about 5 to 10 dozen of said pantyhose in a single dye bag.

26. The method according to claim 19, wherein step (a) further includes individually folding each of said pantyhose after dyeing.

27. The method according to claim 26, wherein step (a) further includes packaging said folded pantyhose for shipment to an end user.

28. The method according to claim 19, wherein step (b) further includes folding a plurality of said pantyhose together before bagging.

29. The method according to claim 28, wherein step (b) includes folding between about 6 to 12 pair of said pantyhose together before stacking in a single dye bag.

30. The method according to claim 19, further including step (d) dyeing said pantyhose in a dye bag.

31. The method according to claim 30, wherein step (d) includes dyeing between about 1 to 3 dozen of said pantyhose in a single dye bag.

32. The method according to claim 30, further including step (e) removing said pantyhose from said dye bag and drying said pantyhose.

33. The method according to claim 32, wherein step (e) further includes individually folding each of said pantyhose after drying.

34. The method according to claim 33, wherein step (e) further includes packaging said folded pantyhose for shipment to an end user.

* * * * *